US007891233B2

(12) United States Patent
Thornton

(10) Patent No.: US 7,891,233 B2
(45) Date of Patent: Feb. 22, 2011

(54) BLAST MOVEMENT MONITOR

(75) Inventor: Darren Mark Thornton, Bellbowrie (AU)

(73) Assignee: Thorncorp Pty Ltd, Bellbowrie, Queensland (AU)

( * ) Notice: Subject to any disclaimer, the term of this patent is extended or adjusted under 35 U.S.C. 154(b) by 421 days.

(21) Appl. No.: 11/556,846

(22) Filed: Nov. 6, 2006

(65) Prior Publication Data

US 2007/0151345 A1 Jul. 5, 2007

Related U.S. Application Data

(63) Continuation-in-part of application No. 10/854,905, filed on May 27, 2004, now Pat. No. 7,367,269.

(60) Provisional application No. 60/531,534, filed on Dec. 19, 2003.

(30) Foreign Application Priority Data

May 27, 2003 (AU) ..... 2003902609

(51) Int. Cl.
*G01N 33/22* (2006.01)

(52) U.S. Cl. ..... 73/35.14

(58) Field of Classification Search ..... 73/35.14, 73/35.16; 324/207.11
See application file for complete search history.

(56) References Cited

U.S. PATENT DOCUMENTS 4,430,757 A * 2/1984 Szakvary ..... 455/100
4,602,215 A 7/1986 Ryaboshtan et al.

(Continued)

FOREIGN PATENT DOCUMENTS

| | | |
|---|---|---|
| AU | 2004202247 | 12/2004 |
| DE | 3 317 787 | 11/1984 |
| RU | 2098845 C1 | 12/1997 |
| SU | 585 287 | 12/1977 |
| SU | 1 257 597 | 9/1986 |

OTHER PUBLICATIONS

Australian Search Report Corresponding to Australian Patent Application No. 2003907060, Mailed Jan. 30, 2004.

*Primary Examiner*—Hezron Williams
*Assistant Examiner*—Nathaniel Kolb
(74) *Attorney, Agent, or Firm*—Greenlee Sullivan P.C.

(57) ABSTRACT

A blast movement monitor for measuring the movement of material within a body of material as a result of a blasting operation, the monitor including:

a housing having an interior chamber defining an inner surface; and an internal communication device that is received immediately within the interior chamber of the housing, the internal communication device including:

a body portion;

an electric coil wound around the body portion;

a circuit board electrically connected to the coil;

a battery electrically connected to the circuit board;

an end portion associated with one end of the body portion; and a cap associated with an opposing end of the body portion that encapsulates the body portion and sealingly houses the body portion;

wherein the internal communication device is biased to facilitate self-righting of the internal communication device to a desired orientation within the interior chamber independent of the orientation of the monitor.

19 Claims, 2 Drawing Sheets

U.S. PATENT DOCUMENTS 4,845,493 A * 7/1989 Howard ..... 340/853.7
5,313,365 A * 5/1994 Pennisi et al. ..... 361/760
5,430,953 A 7/1995 de Souza
6,062,085 A 5/2000 Song
6,504,478 B1 * 1/2003 Yen et al. ..... 340/540
7,367,269 B2 * 5/2008 La Rosa et al. ..... 102/301
2005/0012499 A1 * 1/2005 La Rosa et al. ..... 324/207.15
2006/0170423 A1 8/2006 Kohgo et al.
2007/0169542 A1 * 7/2007 Thornton et al. ..... 73/35.14

* cited by examiner

BLAST MOVEMENT MONITOR

CROSS-REFERENCE TO RELATED APPLICATIONS

This application is a continuation-in-part application of prior U.S. application Ser. No. 10/854,904, filed May 27, 2004, which claims benefit of U.S. Provisional Patent Application No. 60/531,534 filed Dec. 19, 2003 and which claims priority to Australian Patent Application No. 2003 902609 filed May 27, 2003, all of which are incorporated by reference in their entirety herein.

PARTIES TO A JOINT RESEARCH AGREEMENT

At least some of the subject matter described in this application was made by Thorncorp Pty Ltd. and on behalf of Blast Movement Technologies Pty. Limited atf LADD Trust as a result of activities undertaken within the scope of a joint research agreement between JKTech Pty Limited (the commercialization office of the University of Queensland) and Blast Movement Technologies Pty. Limited atf LADD Trust (Thorncorp Pty Ltd. is the intellectual property holding company of Blast Movement Technologies).

FIELD OF THE INVENTION

The invention relates to a blast movement monitor for measuring the movement of material within a body of material as a result of a blasting operation. The invention also extends to an apparatus for determining the movement of a boundary between different portions of a body of material as a result of a blast.

This invention has particular but not exclusive application to the determination of the movement of an ore boundary resulting from a blasting operation. Typically the boundary might be between high grade ore, for example a vein of gold ore, and a low grade ore in a heterogeneous ore body of an open cast mine that practises open cut selective mining.

It will be convenient to hereinafter describe the invention with particular reference to open cut selective mining. However it is to be clearly understood that the invention is capable of broader application. For example, the invention may be used to determine the movement in boundaries between ore and waste for many ores. It may also be used to measure the boundary movement between sulphide ore and oxide ore in fractional deposits. These ores require different concentration processes and therefore need to be recovered separately. It may also be used to measure the movement of the edge of a coal seam when the overburden is blasted.

BACKGROUND TO THE INVENTION

Open cast mining operations are well known and are conducted in a number of countries around the world. Typically they comprise progressively mining domains of an ore body in a staged batch-like process. Each so called batch comprises selectively placing explosives in the rock of the batch. Thereafter the rock is blasted to break and loosen the rock and form a muck pile. Typically the deposits in these mines are heterogeneous in the sense that the ore is disseminated in complex shaped volumes of varying grade within a host rock which is waste. The shape of each ore zone on a horizontal plane is represented by a polygon when viewed in plan.

The rock body, for example, might comprise one or more ore polygons that are economic to recover and waste rock that is to be discarded. The ore is selectively removed from the muck pile and sent to a concentrator where the valuable mineral is extracted by an appropriate technique. Similarly, the waste rock is removed and sent to a discard rock dump. Clearly an important part of this process is the accurate delineation and identification of the boundaries between high grade ore and low grade ore and between ore and waste. A mixture of scientific know-how, geology, computer modelling, and experience is used to determine the boundaries in the body of rock prior to blasting being conducted. This art has developed to the point where mining engineers and geologists have a good three dimensional picture of the boundaries between the different ores in the virgin rock prior to blasting.

However, blasting of the rock body causes some expansion of the rock body. In addition there may be some differences in the amount of movement of the different parts of the rock body.

Mining engineers and geologists sometimes work on the assumption that the ore boundaries of the blasted rock body are the same as that for the rock body prior to blasting and direct the broken rock to the concentrator and the dump respectively on this basis.

The problem is that the rock and therefore also the ore boundaries do move. Accordingly, if this movement is not accounted for by the mining engineers in the mining operation some of the desirable ore is directed to the dump. This leads to a loss of product which is intended to be recovered. Similarly, some of the waste is recovered in the ore stream and is sent to the concentrator. This can lead to a significant loss of efficiency in the concentrators as it processes more waste and less product. This can lead to a drop off in the volume of concentrate produced per unit time.

It is universally recognised that this approach is unsatisfactory. It would therefore be highly desirable if a way could be devised of measuring the movement of the rock and thereby the ore boundaries. It would enable a three dimensional picture of the ore boundaries in the pre-blast rock body to be adjusted to account for the measured rock movement. This in turn would improve the correct reporting of the ore to the concentrator and the waste to the dump.

A method for the determination of movement of a boundary between ores of different grades, or between product and waste rock, has been described in Australian Patent Application No. 2004202247. A monitor for use in such a method has also been described in that document. The monitor described includes a transmitter that is located within a casing. The casing is in turn located within an outer housing, the casing being capable of movement within and relative to the housing. While this arrangement has been found to provide some advantages in many instances, it has been found to be unsuitable in some circumstances.

SUMMARY OF THE INVENTION

According to one aspect of the invention there is provided a blast movement monitor for measuring the movement of material within a body of material as a result of a blasting operation, the monitor including:

- a housing having an interior chamber defining an inner surface; and
- an internal communication device that is received immediately within the interior chamber of the housing, the internal communication device including:
  - a body portion;
  - an electric coil wound around the body portion;
  - a circuit board electrically connected to the coil;
  - a battery electrically connected to the circuit board;

an end portion associated with one end of the body portion; and a cap associated with an opposing end of the body portion that encapsulates the body portion and sealingly houses the body portion;

wherein the internal communication device is biased to facilitate self-righting of the internal communication device to a desired orientation within the interior chamber independent of the orientation of the monitor.

The term "wound around" as used above is intended to include embodiments where the coil is wound around the external surface of the body portion, and also includes embodiments where the coil is wound within the material forming the body portion. That is, the term includes embodiments where the coil is moulded and wound within the material of the body portion.

Preferably, the end portion and cap of the internal communication device have clearances of greater than 1 mm from the inner surface of the internal chamber. More preferably, the end portion and cap of the internal communication device have clearances of at least 3.5 mm from the inner surface of the internal chamber.

The internal communication device includes an electric coil wound around the body portion and coupled to a circuit board which is in turn coupled to an electrical supply. As such, electrical current can be passed through the coil to generate an electro-magnetic field. In that case, the monitor may be locatable by detecting a signal corresponding to a magnetic field component of the electromagnetic field generated by the coil. The signal may have a specific frequency. Preferably the signal is a low frequency signal. A low frequency signal is preferred because it is attenuated to a lesser extent by the surrounding rock than a high frequency signal. For example, the signal that is produced may have a frequency in the range of from 1 to 300 kHz. Preferably the signal has a frequency of from 10 to 200 kHz, more preferably 20 to 150 kHz, even more preferably 30 to 80 kHz, and most preferably about 67.3 kHz.

In a preferred embodiment, the battery and circuit board (PCB) are housed within the body portion and/or the end portion, although it will be appreciated that these components may also be housed in a gap formed between the body portion and cap. More preferably the battery and PCB are encased in the body portion, for example using a suitable resin. More preferably the battery and PCB are encased in an epoxy resin within the body portion and at least partially within the end portion of the internal communication device. As such, when the battery and PCB are encased in a suitable resin, particularly epoxy resin, within the body portion, they are effectively protected from external elements.

The internal communication device is biased to facilitate self-righting of the internal communication device to the desired orientation within the interior chamber independent of the orientation of the monitor. The self-righting nature of the internal communication device may be achieved by any suitable means. Preferably, the centre of mass of the internal communication device is axial and below a centre point of the internal communication device so that the internal communication device aligns itself vertically within the interior chamber independent of the orientation of the monitor.

Having a preponderance of mass in a lower half of the internal communication device advantageously causes the internal communication device to tend to revert to its upright position if it is moved out of its upright position.

The end portion and cap may take any suitable form provided that the cap encapsulates the body portion and sealingly houses the body portion. Generally, there is sufficient clearance between the end portion and the cap of the internal communication device and the inner surface of the internal chamber to facilitate completely free movement of the internal communication device within the chamber. For example, the end portion and cap may form a sphere defining an outer surface of the internal communication device. If so, the inner surface of the housing is preferably curved such that the curved outer surface of the internal communication device and the inner surface are complementary in shape.

The end portion may be detachable from the body portion of the internal communication device. If so, the end portion includes at least one protruding rib that is locatable within a corresponding at least one indentation in a mating surface within the body portion so that the two components can be pressed and clipped together. According to this embodiment, it is preferred that two or more ribs and corresponding indentations be provided to facilitate a water tight seal. It is also preferred that a suitable sealant be provided to prevent water ingress into the body portion.

Alternatively, and preferably, the end portion is integral with the body portion. That is, the end portion and body portion are a one-piece moulding. If the end portion is integral with the body portion, this may be achieved, for example, through injection moulding of the body portion and end portion.

Turning to the form of the cap, the body portion may include at least one rib, generally located in close proximity to the end portion that co-operates with at least one indentation in a mating surface within the cap. In that case, the cap engages the body portion in a snap-fit type engagement that preferably forms a water tight seal. Preferably, however, the cap and end portion are configured such that they fit snuggly together and are secured together with an adhesive or by welding, for example by plastic welding.

The housing may contain a liquid intermediate the internal communication device and the inner surface of the internal chamber to assist freedom of movement of the internal communication device relative to the housing. The liquid may be any suitable liquid, but is preferably water or oil. If working in sub-zero temperatures, it may be desirable to use a liquid that does not freeze at such temperature. For example, in these conditions ethylene glycol may be the liquid of choice. More particularly, it is preferred that the liquid be included within the internal chamber, and that the internal communication device be neutrally buoyant such that the internal communication device effectively floats within the internal chamber.

Preferably, according to this embodiment, to ensure that the assembled internal communication device rotates freely in the housing, the density of the assembled internal communication device is very close to that of the liquid within which it is immersed. Ideally, the internal communication device has a density that is the same as the liquid within which it is immersed. When this occurs the internal communication device has zero weight in the liquid and neutral buoyancy. As such, it may float in the liquid. This assists in reducing friction between the internal communication device and the inner wall of the internal chamber. When water is used as the liquid, the assembled internal communication device preferably has a density of 1 g/cm$^3$. That is, the internal communication device preferably has neutral buoyancy in water.

In addition to facilitating ease of movement of the internal communication device within the internal chamber of the housing, the liquid may serve to damp energy from the blast and thereby reduce the risk of damage to the internal communication device.

It is obviously desirable that the body portion, end portion and cap of the internal communication device be reasonably robust such that they withstand blasting of the rock body being monitored. At the same time these components are desirably light weight so that the monitor as a whole can be moved around with ease, and preferably carried around. Furthermore, it is preferred that the material of construction of these components be non-conductive so that the material does not affect the electromagnetic field produced. Polyvinyl chloride (PVC), Nylon, polyethylene and polystyrene have been found to have these properties. Polyethylene is the preferred material for the body portion, end portion and cap of the internal communication device, although PVC is also well suited for these components.

The housing may take any suitable form. For example, the housing may be formed from two parts that are releasably attached to each other to enable the housing to be opened up when required to gain access to the internal communication device. If so, the two parts of the housing may be attached by fastening elements, such as screws, or the two parts of the housing may have complementary screw threads to enable the two parts to be screwed together. It has been found that the degree of failure of the monitors during blasting is reduced when threaded attachment is used in place of fastening elements such as screws. Alternatively, the two halves of the housing may be secured together with an adhesive or may be welded together. In such cases, it will be appreciated that the housing may not be opened to provide access to the internal communication device.

The housing may have any configuration that will facilitate its use in the field. For example, the housing may have a cylindrical or spherical configuration. Spherical configurations may be advantages if the housing is to be injection moulded as would be appreciated by those of skill in the art. Like the internal components, the housing is preferably made from a resilient material. For example, the housing may be made from a plastics material, such as a nylon or PVC.

It is envisaged that the PCB controlling operation of the monitor may be programmable. Moreover, the internal communication device may be configured such that any signal transmitted is intermittent, rather than being continuous. This may provide for longer life of the signal following a blasting operation. It is also envisaged that remote or delayed activation may be provided for, wherein the monitors according to the invention may be placed in the rock body and remotely activated at an appropriate time prior to blasting, or activate themselves after a certain time frame. The internal communication device may be programmed to transmit a uniquely identifiable signal such that with a matching detector the signal from two or more monitors in close proximity can be distinguished. This allows for more than one monitor to be placed in a single hole prior to blasting enabling the direct measurement of the vertical profile of the movement of the material at that point.

According to another aspect of the invention there is provided an apparatus for determining the movement of a boundary between different portions of a body of material as a result of a blast, the apparatus including:

- at least one blast movement monitor as described above; and
- an external communication device for communicating with the internal communication device of the blast movement monitor.

The external communication device may be a detector or receiver for detecting signals from the internal communication device in the blast movement monitor. The detector or receiver may include an antenna.

The detector may be capable of detecting the magnetic component of an electromagnetic field. For example, the detector may be a magnetic coil tuned to the same frequency as the signals transmitted by the internal communication device, thereby facilitating reception of a signal from the monitor.

An amplifier may also be provided that is operatively coupled to the detector. For example, this may be operatively coupled to the magnetic coil of a detector to increase the sensitivity of the detector.

Conveniently the detector may be hand held and in use it will be carried by an operator moving across the surface of the blasted rock body.

In use, the detector may sense the magnetic component of the electro-magnetic field generated by the transmitter and also the strength of the magnetic field at a particular point.

In normal use, the coil of the internal communication device is oriented in the horizontal plane. In that orientation, the detector may be used to locate the XY position of a monitor on an imaginary XY plane extending broadly parallel to the ground surface by locating the point on the surface of the muck pile where the magnetic field signal is at its greatest. If the coil of the internal communication device is oriented in the vertical plane, the detector will measure a null reading immediately above the blast movement monitor. This in effect amounts to locating the position on the surface beneath which the monitor is located. The situation of the monitor on an imaginary XY plane or top plan view of the site may be established to an accuracy of less than 0.5 metres.

The vertical depth of the monitor within the muck pile can be gauged by measuring the strength of the magnetic field at the point on the surface where the magnetic field signal is at its greatest. The strength of the magnetic field on the surface is a function of the depth of the monitor. As a general rule the intensity of the magnetic field decays as a function of the cube of the distance from the source.

In preferred forms of the invention a monitor can be detected up to a depth of 30 metres on an imaginary Z axis. Instead, or in addition, the vertical depth of the monitor within the muck pile can be gauged by measuring the angle of the magnetic field sensed by the detector. In this way, the angle at which magnetic field lines cut the surface of the rock can be used to locate the source of the magnetic field. Generally the angle of the magnetic field lines relative to an imaginary horizontal line on the surface is measured.

Thus, the movement of the monitor in the muck pile can be measured in three dimensions. That is, its movement on an imaginary XY plane and also movement in its depth that is in a mutually orthogonal Z axis.

A plurality of said movement monitors may be placed within the rock body spaced apart from each other within the rock body. The monitors will generally be positioned up to 15 metres beneath the surface of the rock body. Preferably each monitor is positioned from 1 to 10 metres beneath the surface of the rock body.

Conveniently each monitor is placed within a hole, for example a drill hole, within the rock body. Further, each drill hole is generally filled with drill cuttings once a monitor has been placed in a respective hole.

BRIEF DESCRIPTION OF THE DRAWINGS

It will be convenient to hereinafter provide a detailed description of a preferred embodiment of the invention with reference to the accompanying drawings. The purpose of providing this detailed description is to instruct persons having an interest in the subject matter of the invention how to put the invention into practice. It is to be clearly understood however that the specific nature of this detailed description does not supersede the generality of the preceding statements. In the drawings.

DETAILED DESCRIPTION OF THE PREFERRED EMBODIMENTS

Figure 1:
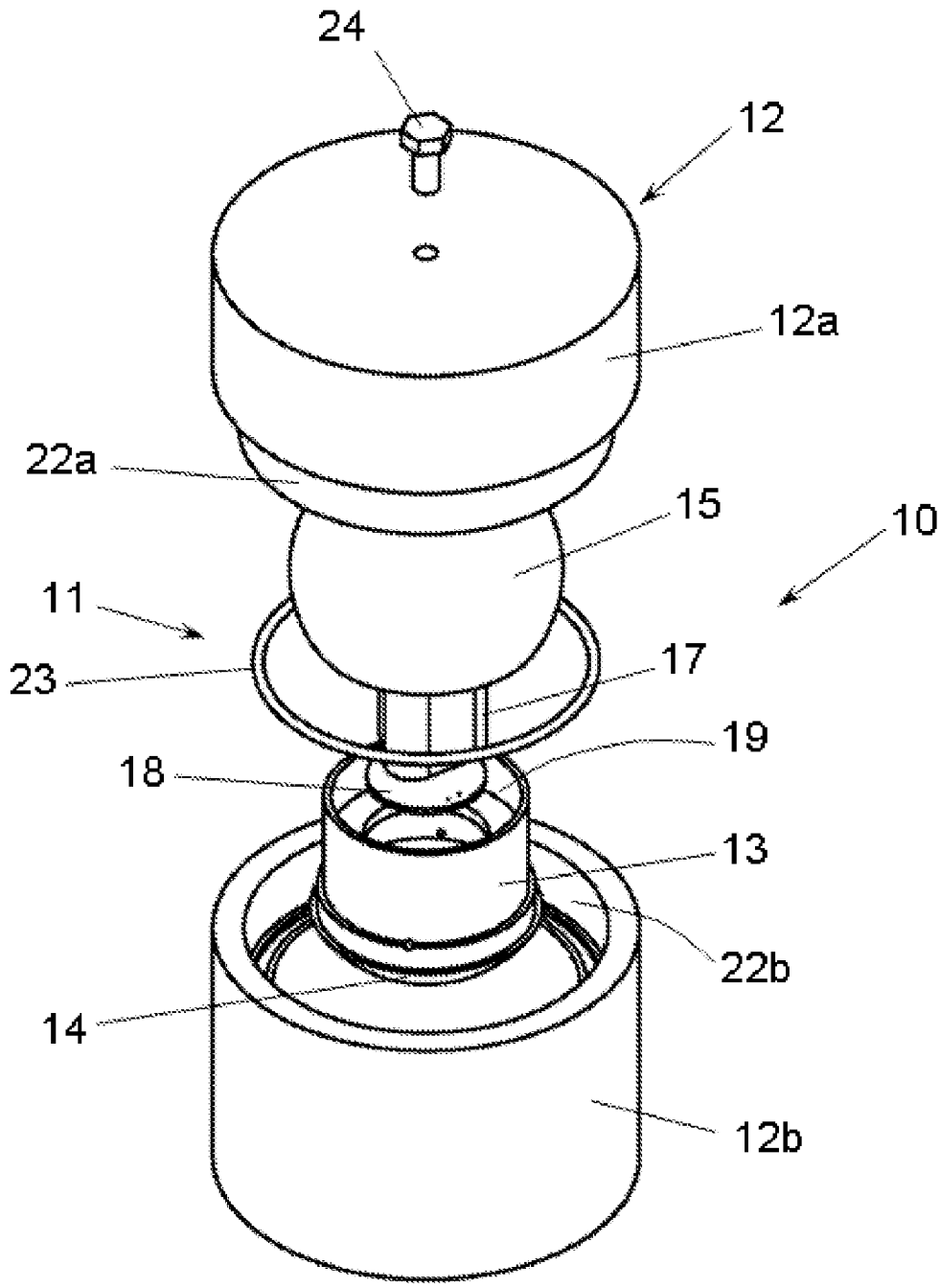
FIG. 1 illustrates an exploded front view of a blast movement monitor.
Figure 2:
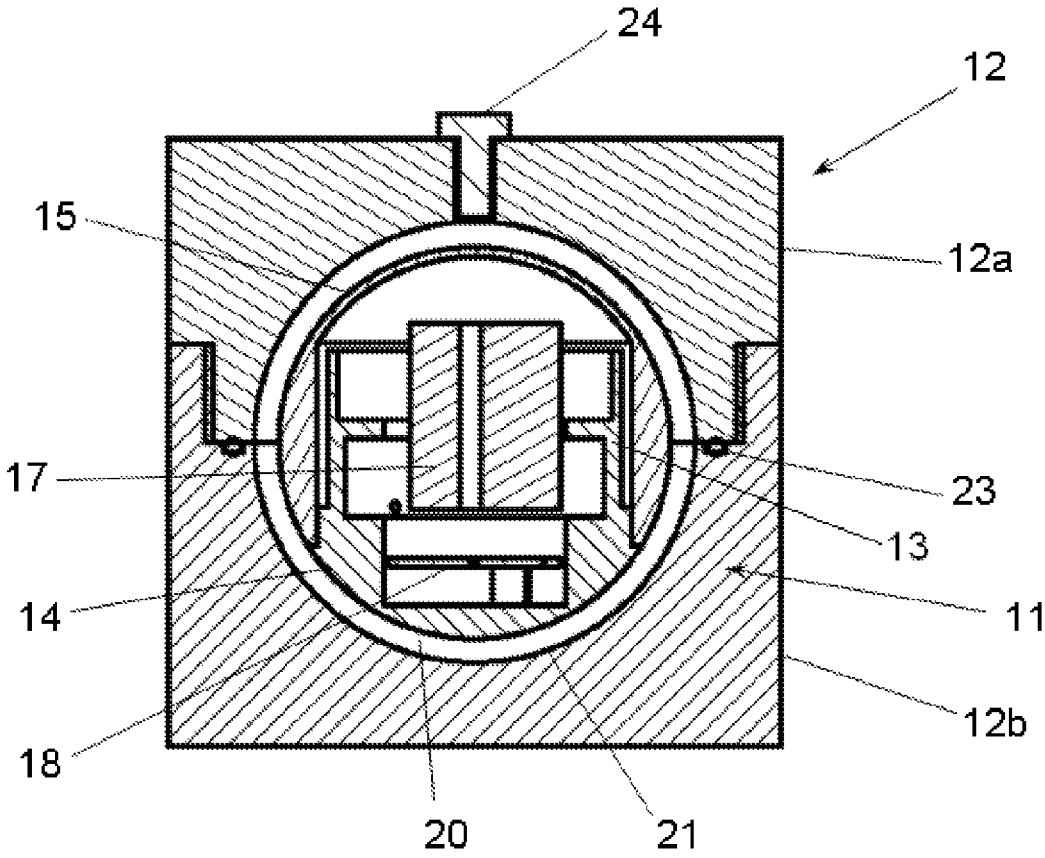
FIG. 2 illustrates a cross-sectional view of the assembled blast movement monitor of FIG. 1.

Referring to FIGS. 1 and 2 which have common numbering for convenience, a blast movement monitor 10 is illustrated. The monitor 10 includes an internal communication device 11 and a housing 12. The device 11 includes a body portion 13, an end portion 14 and a cap 15. The cap 15 is secured to the body portion 13 using a suitable adhesive or by plastic welding. As such, the cap 15 encapsulates the body portion 13 and the components housed within the body portion 13 as described in more detail below.

The body portion 13 and end portion 14 may be integral with each other or may be clipped together using a snap-fit type engagement. However, this is of no particular importance in the context of the invention. Generally, the body portion 13 and the end portion 14 are integral with one another. That is, they are of a one-piece construction.

The body portion 13 defines a cavity 19 that is closed at one end by the end portion 14. A battery 17 is housed within the cavity 19 formed by the body portion 13 and the end portion 14. The battery 17 is coupled with a printed circuit board 18 which is also coupled with an electrical coil wound on the body portion 13. The printed circuit board 18 is also housed within the cavity 19. When the battery 17 and circuit board 18 are located within the cavity 19, an epoxy resin is introduced to the cavity 19 to encase the battery 17 and circuit board 18. This, together with securing of the cap 15 onto the body portion 13, insulates these components and the coil wound around the body portion 13 from the external environment.

The housing of the battery 17 and PCB 18 in the body portion 13, and the encapsulation of the body portion 13 within the cap 15 is best illustrated in FIG. 2.

The device 11, once assembled, is located in an internal chamber 20 of the housing 12, defined when an upper half 12*a* and a lower half 12*b* of the housing are engaged. As best illustrated in FIG. 2, when assembled the chamber 20 has an inner surface 21 that is smooth and which defines a sphere. As such, the curved surfaces of the end portion 14 and cap 15 run smoothly over the curved inner surface 21 of the spherical chamber 20. The device 11 is configured such that its centre of mass is axial and below a centre point of the device 11. This ensures that the device 11 aligns itself vertically within the chamber 20 independent of the orientation of the monitor 10.

In order to lower any frictional resistance between the device 11 and the inner surface 21 of the chamber 20, a liquid, generally water, is included in the gap between the device 11 and the inner surface 21. This may also reduce the chance of damage to the monitor 10 during the blasting operation.

The housing 12 is formed from two halves 12*a* and 12*b*. The two halves 12*a* and 12*b* are securable to one another by threads 22*a* and 22*b* and have an o-ring seal 23 there between to ensure a water tight seal between the two halves 12*a* and 12*b*. This ensures that any liquid between the device 11 and the inner surface 21 of the chamber 20 does not leak out during use. It is envisaged that in situations where the two halves 12*a* and 12*b* are welded together, it may be possible to do away with the o-ring seal 23.

A screw 24 is also provided to facilitate filling of the space between the inner surface 21 of the chamber 20 and the internal communication device 11. The screw may be replaced with a press fit plug (not shown). A key hole arrangement may be provided that can be engaged by a complementary tool for tightening of the two halves 12*a* and 12*b*.

The present invention provides a number of potential advantages over the prior art of record. In particular, the relatively small diameter of the monitor, made possible by innovative design of the internal communication device, may make it suitable for use in a wider variety of applications. The coupling between components may improve the survivability of each monitor unit during blasting. A decrease in costs is also provided by reducing the number of components and materials required to form the monitor of the invention. Functionality may also be improved by increasing the transmission time. With regard to the embodiment described above, given that the coil is wound around the body portion thereby integrating the coil into the structure of the internal communicating device itself as opposed to being housed within an inner housing, for the same sized coil the inner assembled components is smaller. Consequently, the device on the whole is smaller.

It will of course be realised that the above has been given only by way of illustrative example of the invention and that all such modifications and variations thereto as would be apparent to persons skilled in the art are deemed to fall within the broad scope and ambit of the invention as is herein set forth.

The invention claimed is:

1. A blast movement monitor for measuring the movement of material within a body of material as a result of a blasting operation, the monitor including:

a housing having an interior chamber defining an inner surface; and an internal communication device that is received immediately within the interior chamber of the housing, the internal communication device including:

a cylindrical body portion;

an end portion formed integrally with one end of the body portion in order that the end portion and body portion define a cavity that is closed at one end by the end portion an electric coil wound around the body portion;

a circuit board electrically connected to the coil;

a battery electrically connected to the circuit board;

the battery and circuit board being housed within the cavity; and a cap associated with an opposing end of the body portion that encapsulates the body portion and sealingly houses the body portion thereby insulating the body portion, electric coil, circuit board and the battery from the external environment;

wherein the internal communication device is biased to facilitate self-righting of the internal communication device to a desired orientation within the interior chamber independent of the orientation of the monitor.

2. A blast movement monitor according to claim 1, wherein the electric coil is wound on an external surface of the body portion.

3. A blast movement monitor according to claim 1, wherein the electric coil is moulded and wound within material forming the body portion.

4. A blast movement monitor according to claim 1, wherein the end portion and cap of the internal communication device have clearances grater than 1 mm, preferably at least 3.5 mm, from the inner surface of the internal chamber.

5. A blast movement monitor according to claim 1, wherein an electrical current can be passed through the electric coil to generate an electro-magnetic field.

6. A blast movement monitor according to claim 1, wherein the battery and the printed circuit board are encased in an epoxy resin within the cavity of the body portion.

7. A blast movement monitor according to claim 1, wherein the center of mass of the internal communication device is axial and below a center point of the internal communication device so that the internal communication device aligns itself vertically within the interior chamber independent of the orientation of the monitor.

8. A blast movement monitor according to claim 1, wherein the end portion and cap have curved outer surfaces.

9. A blast movement monitor according to claim 8, wherein the end portion and cap form a sphere when the cap is secured to the body portion.

10. A blast movement monitor according to claim 9, wherein the inner surface of the housing is curved.

11. A blast movement monitor according to claim 1, wherein the cap is adhered or welded to the body portion.

12. A blast movement monitor according to claim 1, wherein the housing contains a liquid intermediate the internal communication device and the inner surface of the housing to assist freedom of movement of the internal communication device relative to the housing.

13. A blast movement monitor according to claim 1, wherein the housing is formed from a plastics material and includes two halves releasably attached to each other to enable the housing to be opened to provide access to the internal communication device.

14. A blast movement monitor according to claim 1, wherein the housing is formed from a plastics material and includes two halves adhered or welded to one another.

15. An apparatus for determining the movement of a boundary between different portions of a body of material as a result of a blast, the apparatus including:

at least one blast movement monitor as claimed in any one of the preceding claims; and an external communication device for communicating with the internal communication device of the blast movement monitor.

16. An apparatus according to claim 15, wherein the external communication device is a detector for detecting signals transmitted by the internal communication device.

17. An apparatus according to claim 16, wherein the detector is a magnetic field detector and includes a magnetic coil tuned to a frequency corresponding to a frequency of the signals transmitted by the internal communication device.

18. An apparatus according to claim 16, wherein the detector includes an amplifier operatively coupled to the detector.

19. An apparatus according to claim 16, wherein the detector is hand held and portable.

* * * * *